US005810629A

United States Patent [19]

Parr

[11] Patent Number: 5,810,629

[45] Date of Patent: Sep. 22, 1998

[54] SWIMMING AID

[76] Inventor: Michael Lancaster Parr, 9 Powells Road Unit 27, Brookvale, NSW, Australia, 2100

[21] Appl. No.: 656,330

[22] PCT Filed: Mar. 7, 1995

[86] PCT No.: PCT/AU95/00117

§ 371 Date: Sep. 26, 1996

§ 102(e) Date: Sep. 26, 1996

[87] PCT Pub. No.: WO95/24242

PCT Pub. Date: Sep. 14, 1995

[30] Foreign Application Priority Data

| | | | |
|---|---|---|---|
| Mar. 9, 1994 | [AU] | Australia | PM4341 |
| Sep. 9, 1994 | [AU] | Australia | PM8011 |
| Jan. 25, 1995 | [AU] | Australia | PN0783 |

[51] Int. Cl.[6] ..... A63B 31/08

[52] U.S. Cl. ..... 441/64

[58] Field of Search ..... 441/61, 62, 64

[56] References Cited

U.S. PATENT DOCUMENTS

| | | | |
|---|---|---|---|
| 2,099,973 | 11/1937 | De Corlieu | 441/64 |
| 3,411,165 | 11/1968 | Murdoch | 441/64 |
| 3,422,470 | 1/1969 | Mares | 9/309 |
| 4,007,506 | 2/1977 | Rasmussen | 9/309 |
| 4,954,112 | 9/1990 | Negrini et al. | 441/64 |
| 5,358,439 | 10/1994 | Paolo | 441/64 |

FOREIGN PATENT DOCUMENTS

| | | |
|---|---|---|
| 76752/87 | 2/1988 | Australia . |
| 1407485 | 6/1965 | France . |

*Primary Examiner*—Stephen Avila

*Attorney, Agent, or Firm*—Jacobson, Price, Holman & Stern, PLLC

[57] ABSTRACT

A swimming aid which includes a main body having a support section by which the swimming aid is carried by the user and a fin section which extends away from the support section and includes a distal free edge portion and spaced apart side edge portions extending between the distal free edge portion and the support section, and at least one elongated substantially resilient element extending from the support section towards the distal free edge portion of the fin.

13 Claims, 5 Drawing Sheets

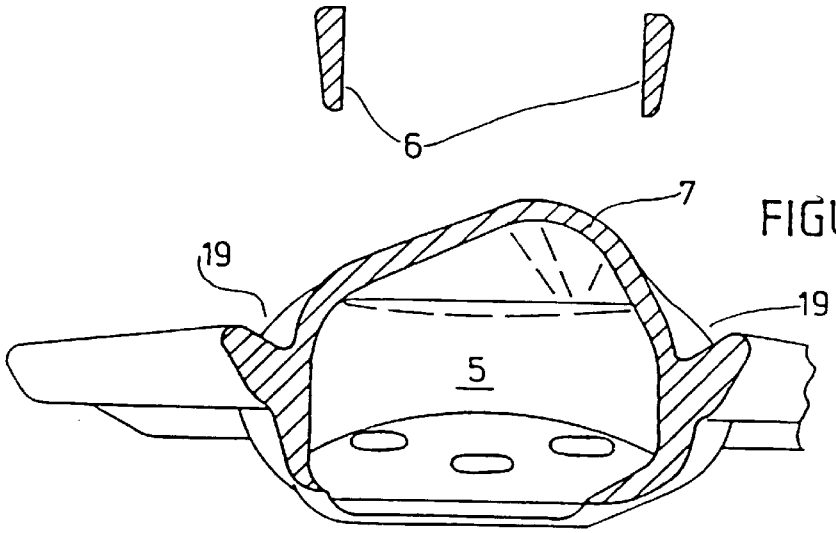
FIGURE 5F
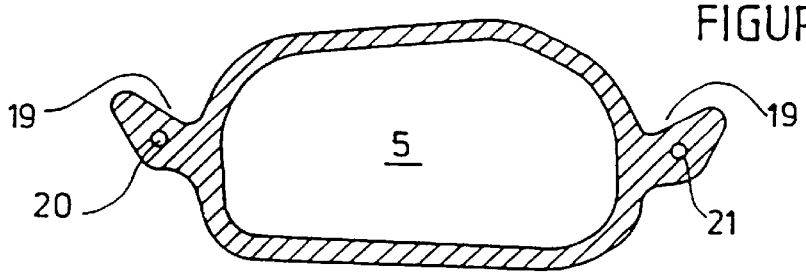
FIGURE 5E
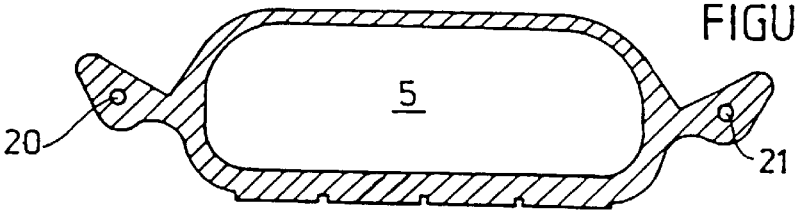
FIGURE 5D
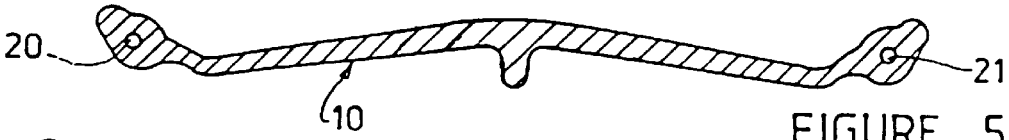
FIGURE 5C
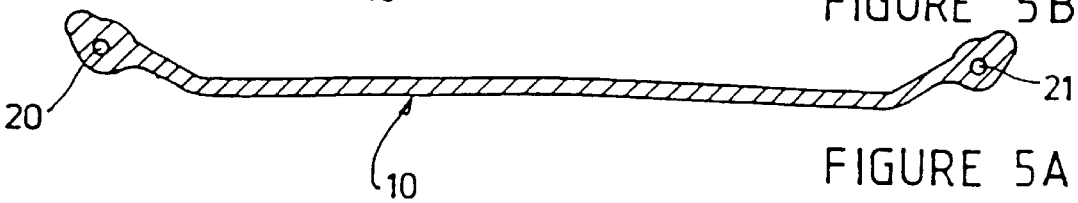
FIGURE 5B
FIGURE 5A

SWIMMING AID

This invention relates generally to swimming aids and more particular, though not exclusively, to swimming aids which are often referred to swim fins or flippers and which are worn on the foot. The invention in another aspect relates to a method of manufacturing such swimming aids.

Swimming aids of the type referred to have been known for many years. Generally such aids are formed from a moulded elastomer such as rubber or synthetic rubber. The efficiency of such swimming aids however, is in essence, limited by the properties of the elastomer used. In order to provide stronger swim fins or flippers it has been necessary in the past to simply increase the amount of elastomer. Not only does this substantially increase the weight of the swim fin but also the cost.

Conventional surfing flippers use a combination of hard and soft rubber in their construction in order to develop power. This is done by using hard rubber in the distal free end of the fin, and soft rubber in the support area of the foot. The hard rubber displaces the water, and the soft rubber provides the needed flex. The lesser the amount of soft support rubber the more the fin will try to bend along the delineation of hard and soft rubber, thus placing the full force created by the kicking action of the user across the toes of the foot, rather than across the bridge of the foot. Likewise, using harder rubber around the foot cavity will aid displacing this force further up the foot, but reduce the advantages of the flex.

It is the object of the present invention to provide an improved swimming aid which alleviates one or more of the aforementioned disadvantages.

According to one aspect of the present invention there is provided a swimming aid which includes a main body having a support section by which the swimming aid is carried by the user and a fin section which extends away from the support section and includes a distal free edge portion and a spaced apart side edge portions extending between the distal free edge portion and the support section, and at least one elongated substantially resilient element extending from the support section towards the distal free edge portion of the fin.

Preferably, the support section includes a cavity or pocket into which the main part of the users foot can be received and a heel support for retaining the users foot in position.

Preferably, the side edge portions of the fin section taper inwardly upwards towards one another from the distal free edge thereof in the direction towards the support, the side edge portions terminating towards the end portion of the support remote from the distal end of the fin.

In one form, a part of each side portion which is disposed adjacent the support may be configured so as to form a "wing section" which tapers upwardly from the upper surface and forms a channel between the outer peripheral edge and the wall of the support.

The inwardly tapered side edge portions of upper and lower surfaces of the preferred form together with its extension adjacent the support forming the "wing section" are designed to (1) enhance the water catchment and control the direction of water flow over upper surface towards the distal leading edges leading to improved thrust, (2) aid the neutralisation of pressures by allowing free movement from the edge along the back of the fin towards the centre leading faster less strenuous up kick (or, return stroke).

During the down ward kick, water is captured in the wing section and directed from as far back as the ankle area down the channel towards the distal blade area of the foot, the wing section in the design effectively does three things:

(1) It increases the surfaces area of the fin thus increasing the thrust potential but without a proportional increase in load pressures on the lower calf muscles and ligaments as the effect required to displace this increased area of water is carried more evenly along the foot (because of the location of the wing section along the side of the foot cavity) thus reducing the load pressures dictated by the physics of leverage wherein the pivoting point is the ankle. This reduces the effort to thrust which inturn lowers oxygen consumption and muscle fatigue (resulting in cramps). This is highly significant to diving fin applications, and any competitive sports which are fin dependant;

(2) Provides an elongated chute which increases the overall water catchment area without making the fin longer in the section from the toes to the distal leading edge, nor wider across the distal leading edge. This is significant to a surfing fin which needs higher levels of thrust potential but a short distal blade.

(3) Both directs and increases the velocity of water flow and water pressure over the blade similar to the principal of a sling shot as the foot and fin move through an arch pivoting from the knee and hip simultaneously. The increased water containment and water pressure over the blade area increases the thrust potential of the fin.

In one preferred form, each resilient element comprises a rod or tube like member having one end adjacent the distal free edge of the fin, and the other end being disposed adjacent the support section. It is desirable that the free ends of the resilient members terminate in the vicinity of the entrance of the foot cavity. It is further desirable that the rods are disposed in close proximity to the side edges of the fin. The rod or tube like resilient members may taper to a reduced cross-sectional dimension towards the distal end of the fin. Preferably, the rods are embedded within the elastomer of the fin so that they tend to bend or deflect at a selected pivot region. The two rods may be bridged via a relatively hard elastomer connecting to the region of the bridge of the user's foot when disposed within the cavity.

The resilience of a rod like resilient member is greater than rubber enabling more efficient use of energy and greater forward movement per unit of energy. It is the soft support rubber that provides the flexible power of a fin using hard rubber in the distal end of the fin. As such replacing the soft rubber with a more resilient and flexible material improves this feature.

In one preferred form of the invention, the rods extend along the side edges of the foot cavity and are completely enclosed in the elastomer. In this particular embodiment the pivot region or regions where the forces created by the flexing of the fins when in use are in the region of the bridge of the user's foot when disposed within the cavity.

In another form of the invention, the end portion of each of the rods adjacent the support are mounted within a cavity in the underside of the main body so that they can move in a downward direction with respect to their normal orientation. To this end, as described in earlier the aforementioned one end of each of the rods may be disposed within the cavity in the underside of the main body. This cavity may be filled with a low resistant material or the rods may simply be exposed within the cavity.

The embodiment of resilient members with superior flex strength and location from the entrance of the foot cavity along the sides of the support down the side edge portions to the free distal edge is significant to the invention wherein it provides superior flex at the distal blade area, and rigid support of the support section.

The flexible members may be formed from carbon-graphite, fibreglass or other suitable materials. The resilience of these elements is greater than rubber or similar elastomer enabling more efficient use of energy and greater forward movement per unit of energy. In conventional fins it is the soft rubber that provides the flexible power of the fin. Furthermore conventional fins use hard rubber in the distal end of the fin to provide rigidity in that region, and soft rubber in the support end of the fin to provide the required flexibility. As such replacing the soft rubber with a more resilient member improves the flexible power at the distal end whilst improves the rigidity of the foot support.

The strength and resilience of the resilient members provides an additional forward propelling action as a result of the energy stored within the rods upon deflection being released as the rods return to their undeflected position further displacing water at the end of both the down-kick stroke and the up-kick stroke, rather than the movement of the foot after the completion of a kick stroke or half-cycle kick returning the fin to the unflexed position. The resilience of the resilient members increases the water displacement for the same level of effort by maximising the length of each kick stroke without requiring longer leg movements. Or more simply, more efficient utilisation of the extremities of the down-kick and up-kick stroke.

The rigidity of the rod along the foot cavity ensures that forces created at the distal free end of the fin are not in most part carried by the leading edge of the foot (ie., the toe region) but evenly displaced over the entire bridge of the foot. This means that the leveraged pressures created by forces being concentrated at the leading edge of the foot are moved closer to the ankle, thereby reducing the actual pressures against the muscle and ligaments of the foot and lower leg region. This facilitates reduction in oxygen consumption and muscle fatigue, which in turn reduces the risk of lower leg cramp, a problem that plagues both amateur and professional swimmers who are fin dependant.

Thus, the rigidity of the rod in the region of the foot cavity and the positioning of the rod relative to the bridge of the foot thereto is significant to the efficiency of the fin. The rod should preferably begin as close to the upper foot area (ie, the ankle region) and desirably should run the full length of the edge of the fin to the leading edge of the distal free end of the fin.

In addition, the greater the degrees of free movement between the foot cavity and the rods, lesser efficiencies will result and more forces will be moved towards the leading area of the foot. That is, energy will be expended in flexing the foot cavity placing more pressure across the toe region without the energy being directed along the rods to the distal portion of the fin to displace water. That is to say, the support end of the rod should desirably be as static as possible, and as such, the end of the rod should begin as close as possible to the ankle region, with minimal distance between the inner wall and the rod, and with minimal latitudinal angles leading away from the foot cavity towards the distal free end of the fin. Therefore, distance between the rod and the inner wall of the foot cavity, the latitudinal angle of the rod along the foot cavity, and the firmness of the rubber walls surrounding the bridge of the foot (with lesser degrees across the toe region) will all affect the static fixation of the support end of the rods and therein relational efficiency of the direct transference of energy to water displacement with the point of transference being contained to the region of the bridge of the foot.

In order to obtain maximum efficiencies in transferring pressures away from the toes and the transferring of energy along the rods to the displacement of water and thus forward movement, the qualities of the resilient member need to be considered. Preferably, the resilient elements have sufficient strength and resilience that during a propelling movement they are deflected and the energy stored during this propelling movement as a result of the deflection can be subsequently used to assist in forward propelling movement by the rod proactively displacing water as it returns to its original undeflected position. In addition, the rod provide strength to the fin in the lateral direction. The ideal resilient member must preferably be able to fulfil two requirements. (1) to flex under the opposing forces of the foot and the resistance of the liquid medium, but have sufficient strength to displace the liquid medium whilst returning to the unflexed position. (2) be sufficiently rigid along the support area along the side of the foot so as to not flex under pressure and transfer this pressure evenly displaced over the entire bridge of the foot. A tapered solid rod is preferable and superior to an untapered hollow or solid rod.

Furthermore, a tapered rod offers gradiated levels of rigidity and flex to overcome the inefficiencies of both using the hard and soft rubber combination to regulate blade stiffness in the fin. A flexible distal end of a swim fin produces less low-pressure turbulence than a rigid distal end of a swim fin. A rigid distal end on a fin creates low pressure turbulence behind the leading edge and side rails, creating overall lower pressure turbulence along the back of the fin when moving forward against a liquid medium. However, a rigid distal end of a swim fin enables more sprint power by using this resistance together with the surface area of the distal end of the fin to leap forward with the disadvantage of the turbulence at the leading edge of the distal end of the fin not allowing the liquid medium to escape cleanly. The advantage of the rods which preferably carbon rods, is that they offer gradiated levels of stiffness to overcome the inefficiencies of a single density hard elastomer composite. Stiffness at the support region with decreasing degrees of stiffness along the side edges generating decreasing levels of lower pressure pockets towards the leading edge of the distal end of the fin which is unsupported allowing free movement to balance the pressures between the upper and lower surface to enable the liquid medium to escape freely.

In one form, the or each resilient element comprises a rod or tube like member which may be either solid or hollow having one end adjacent the distal free edge of the fin, and the other end being disposed adjacent the support section. The resilient elements may be formed from any suitable materials such as carbon, fibreglass or the like. In addition, they may either be parallel sided or tapered and preferably they taper to a reduced cross-sectional dimension towards the distal end of the fin.

Further to the advantages of the present invention, it is the re-enforcing nature of the rods which enables a much lighter fin as the resilient members eliminate the need for larger volumes of rubber to produce similar results. Thus lesser amounts of soft rubber re-enforcement is required in the foot cavity support region. As the resilient members also provide strength to the fin in the lateral direction this enables lesser amounts of elastomer to be used in the distal end of the fin, and slightly softer grades of hard elastomer.

A further advantage is that because of the strength provided by the resilient members within the fin, the support can be made of softer rubber or elastomer thereby providing for a more comfortable support section whilst still maintaining a rigid support cavity to receive the foot and the advantages therein.

As mentioned earlier, the or the each resilient element is at least partially or completely embedded within the main body of the fin. This may be done during the formation of the main body. The formation may be done in any suitable manner and preferably moulding techniques are used.

According to another aspect of the present invention there is provided a method which is suitable for use in the manufacture of a swimming aid according to any preceding claim, the method comprising locating each resilient element within a body of elastomer material, positioning the resilient element and elastomeric body within a mould so that the rod is located in a selected position within that mould and thereafter performing a moulding step to produce the swimming aid.

Preferably, the elastomeric body is in the form of a tube into which the resilient element is located. The tube may be formed by extrusion or any other suitable technique. The elastomeric body may be formed of hard rubber for that part of the resilient element which is adjacent the support section of the swimming aid in its finished condition and a softer rubber for that part of the resilient element in the other section of the swimming aid. Furthermore, the elastomeric body with the resilient element therein is placed in the side rail or side section area of the mould and other amounts of rubber are also placed in the mould, the mould is then closed and heat pressure applied.

As a result of the method of manufacture described above, the resilient elements which are preferably in the form of carbon rods can be located in the mould in such a way that supporting rods which would normally be required and which leaves holes in the finished product are avoided. Whilst it is preferable that the elastomeric body is formed of both hard and soft rubber it could also be formed simply from one material such as soft rubber.

In use, the elastomeric body with the resilient element therein is placed in the side rail or side section area of the mould and other amounts of rubber are also placed in the mould. The mould is then closed and hear pressure applied and the forces surrounding the rod are equalised because the rod is encapsulated and thus, cannot be displaced by the lateral movement of the rubber from the upper and lower chambers of the mould. The end result of this method of manufacture provides for precise placement of the carbon rod within the mould without unsightly holes. There is also reducing tooling costs and reducing labour time associated with fitting the rods into complicated holding tools within the mould. Furthermore, the additional costs of trimming rubber from holes that would otherwise be left from using locating rods for the resilient elements is avoided.

Preferred embodiments of the invention will hereinafter be described with reference to the accompanying drawings in which:

FIGS. 5A to 5F are sectional views of the swimming aid taken along the lines A—A to F—F shown in FIG. 4;

Figure 1:
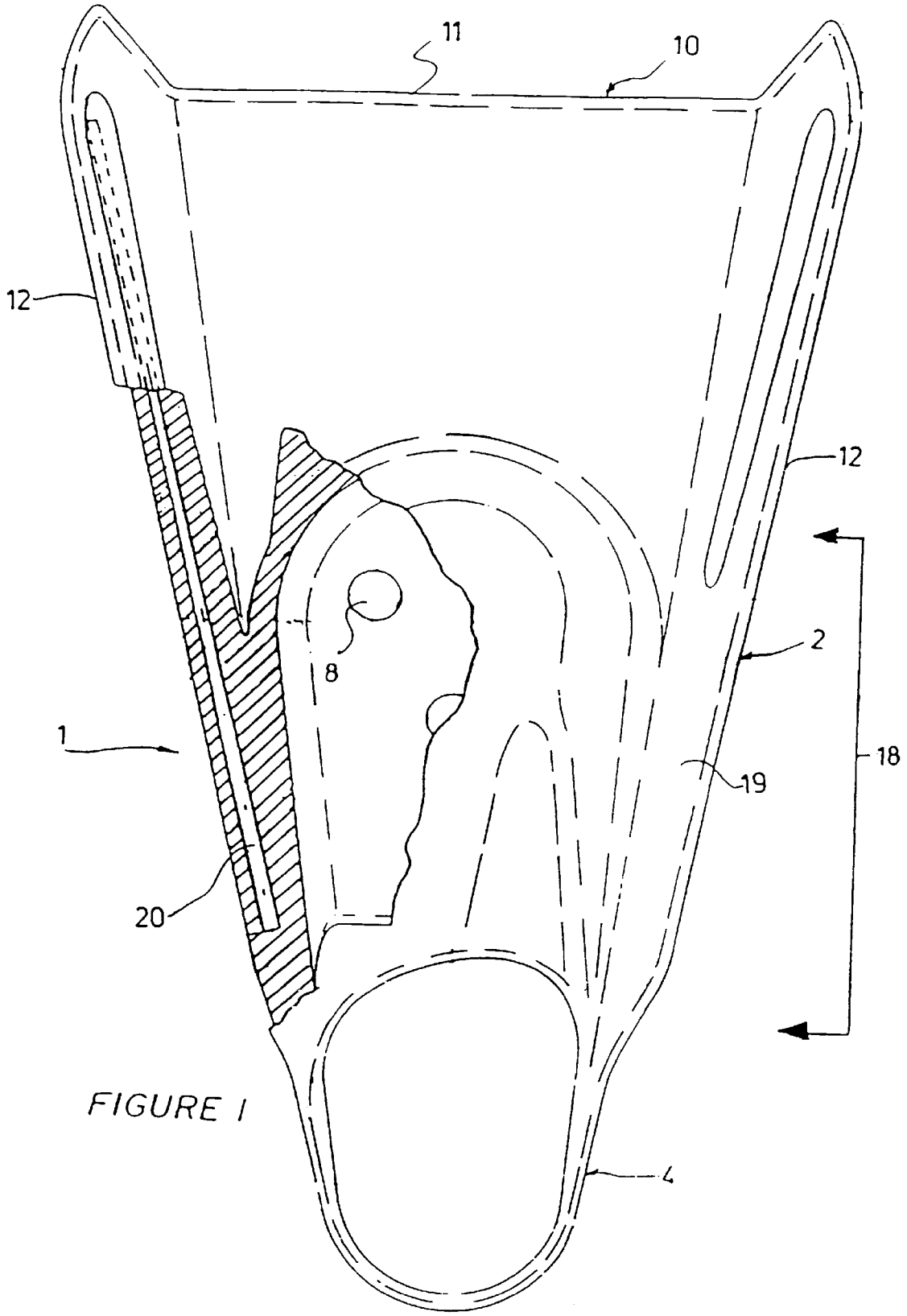
FIG. 1 is a partially cut away plan view of a fin according to one preferred form of the invention.
Figure 2:
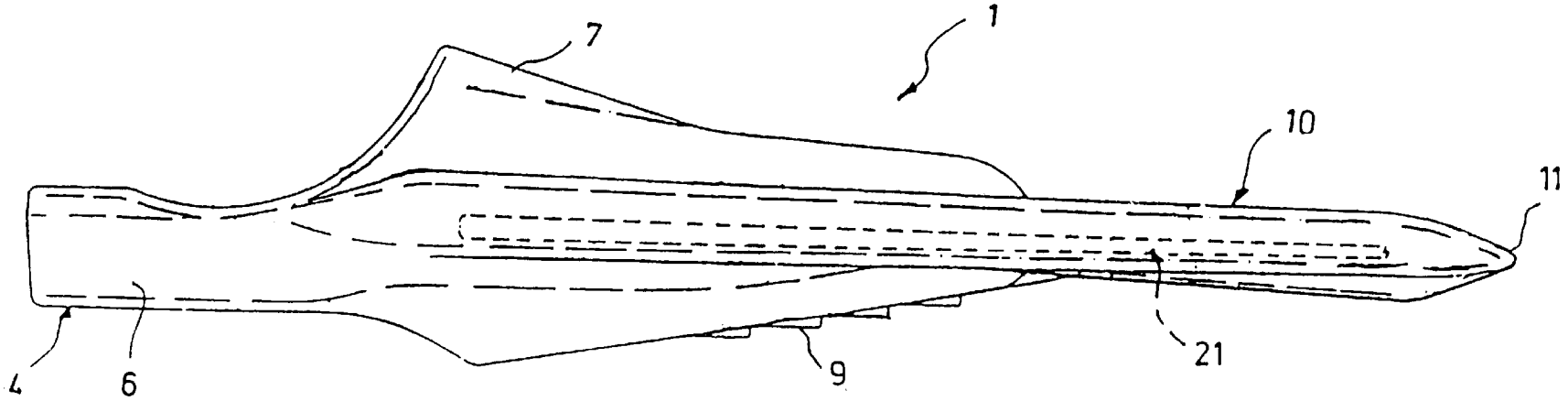
FIG. 2 is a side elevation of the fin shown in FIG. 1.
Figure 3:
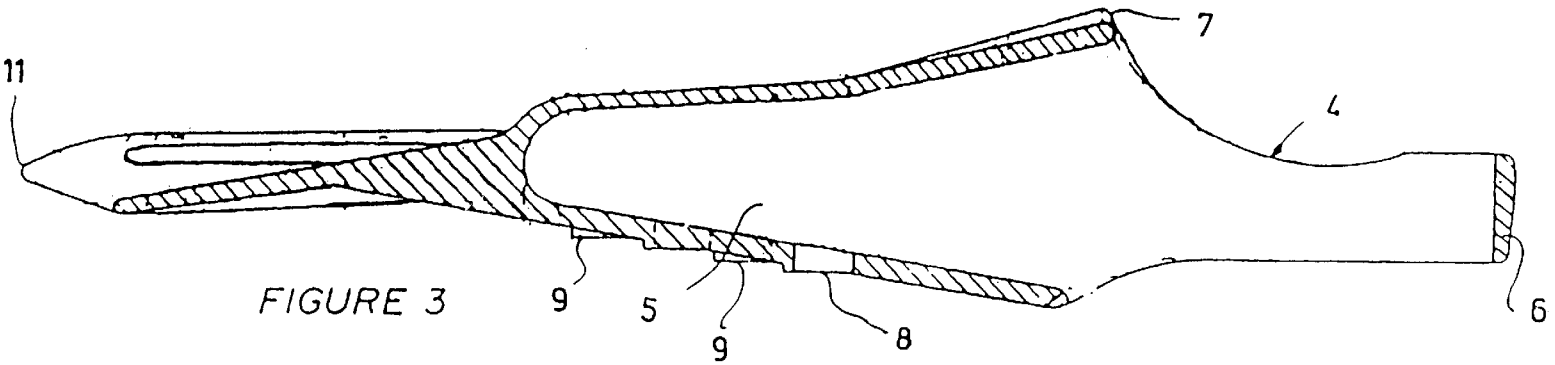
FIG. 3 is a side sectional view of the fin shown in FIGS. 1 and 2.
Figure 4:
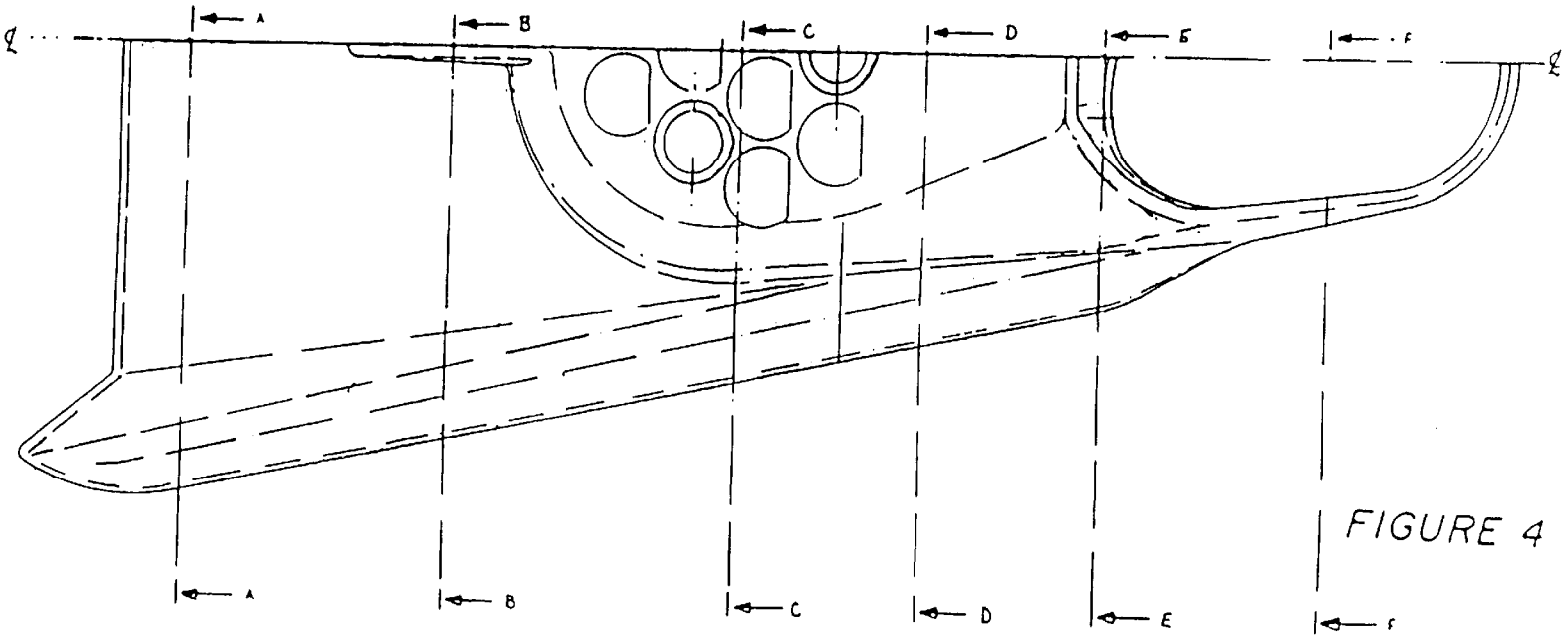
FIG. 4 is a partial underside view of a swim fin according to the invention.

Referring to FIGS. 1 to 5 of the drawings, the swimming aid generally indicated at 1 comprises a elastomeric main body 2 having a support 4 including a foot receiving pocket 5 and heel support 6. The pocket 5 includes a raised foot ridge 7 which extends over the bridge of the users foot and a filled instep section. A drain chute (not shown) or drain hole 8 may be provided which enables water to escape from the pocket 5 and a tread section 9 is provided on the underside of the pocket 5.

The main body further includes a fin 10 having a distal free edge portion 11 and side edge portions 12 connected to the support 4. The side edge portions have a part thereof forming a wing section 18 which is adjacent the foot receiving pocket 5. This part forms a wing section which projects upwardly and forms a channel 19 between the wing section and the foot receiving pocket 5. This is best seen in FIGS. 5C to 5E.

The aid further includes two resilient rods 20 and 21 which in the embodiment of FIGS. 1 to 5 are fully embedded within the side portions of the fin 10 extending from the distal edge 11 and terminating adjacent the sides of the support pocket 5. The rods 20, 21 are adapted to deflect about a pivot region which is disposed in the region of the users foot.

As best seen in FIGS. 5C and 5E the rods are disposed in close proximity to the sides of the pocket 5. The pocket 5 is formed with a soft rubber compound. The ends of the rods terminate in the region of the open end of pocket 5.

Figure 6:
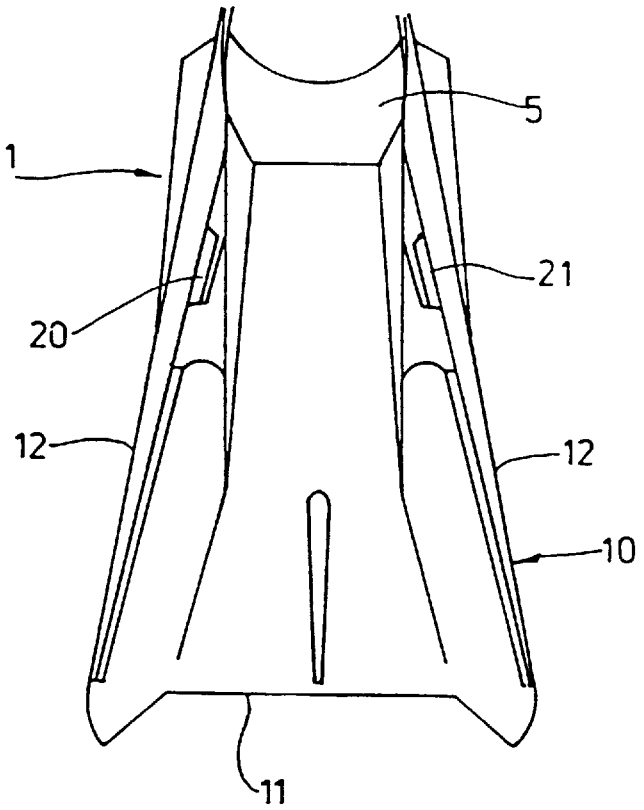
FIG. 6 is a schematic underside view of another embodiment of swim fin.
Figure 7:
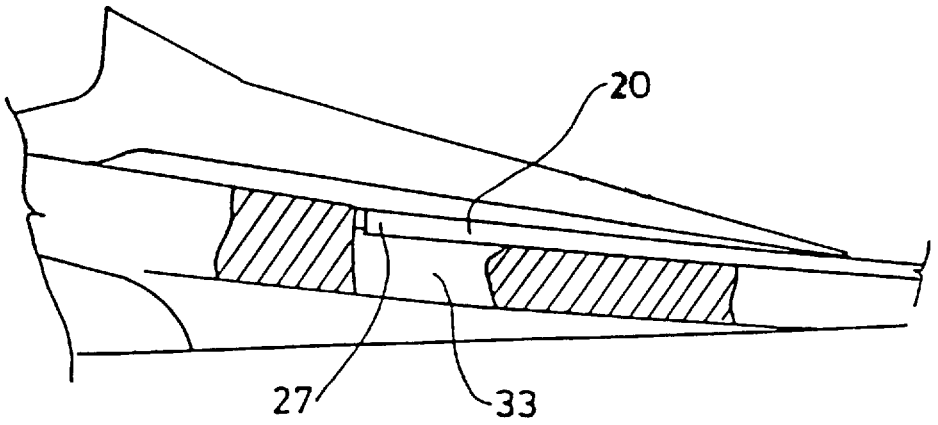
FIG. 7 is a schematic partially sectioned side elevation of the swim fin shown in FIG. 6.

FIG. 6 shows another form of the fin and like numerals have been used to show like parts to those of the embodiment of FIGS. 1 to 5. In this embodiment the rods 20, 21 are adapted to deflect about a pivot region. The ends 27 of the resilient rods 20 and 21 are located within a cavity 33 which permits movement of that end of the rod during the walking procedure.

The pocket 5 is formed with a soft rubber compound and includes a rubber reinforcement band extending thereacross. This limits the degree of upward movement. In addition, hard rubber regions are provided on the underside of the main body, which provide the pivot regions and hold the rods. The rods are interconnected by a relatively hard rubber bridge running under the foot between regions.

Finally, it is to be understood that various alterations, modifications and/or additions may be incorporated into the various constructions and arrangements of parts without departing from the spirit or ambit of the invention.

The claims defining the invention are as follows; I claim:

1. A swimming aid which includes a main body having a support section by which the aid is carried by the user and a fin section which extends away from the support section and includes a distal free edge portion and spaced apart side portions extending between the distal free edge portion and the support section, and at least one elongated substantially resilient element extending from the support section towards the distal free edge portion of the fin section, the at least one elongated substantially resilient element comprising two rod or tube like members each having one end adjacent the distal free edge portion of the fin section and the other end adjacent the support section, the rod or tube like members each being disposed adjacent a respective side edge portion of the fin section, the rod or tube like members tapering to a reduced cross-sectional dimension towards the distal free edge portion of the fin section.

2. A swimming aid according to claim 1 wherein the support section includes a cavity or pocket into which the main part of the users foot can be received and a heel support for retaining the users foot in position.

3. A swimming aid according to claim 1 wherein the side edge portions of the fin section taper inwardly towards one another from the distal free edge thereof in the direction towards the support, the side edge portions terminating towards the end, portion of the support remote from the distal free end of the fin.

4. A swimming aid according to claim 2 wherein a part of each side edge portion which is disposed adjacent the support forms a wing section which tapers upwardly and forms a channel between the outer peripheral edge and the wall of the support.

5. A swimming aid according to claim 1 wherein the or each resilient element is at least partially or completely embedded within the main body of the fin.

6. A swimming aid according to claim 1 wherein the rods are embedded within the elastomer of the fin so that they tend to bend or deflect at a selected pivot region.

7. A swimming aid according to claim 6 wherein the two rods are bridged via a relatively hard rubber section in the pivot region.

8. A swimming aid according to claim 7 wherein the rods extend along the side edges of the foot cavity and the pivot regions are in the region of the bridge of the user's foot when disposed within the cavity.

9. A swimming aid according to claim 8 wherein free ends of the rods terminate in the vicinity of the entrance of the foot cavity, with the rods being disposed in close proximity to the side edges of the cavity.

10. A swimming aid according to claim 1 wherein the end portion of each of the rods adjacent the support are mounted in a fashion so that they can move in a downward direction with respect to their normal orientation, said one end of each of the rods being disposed within a cavity in the underside of the main body.

11. A swimming fin which includes a main body having a support section which includes a cavity or pocket into which the main part of the user's foot can be received and a heel support for retaining the user's foot in position and a fin section which extends away from the support section and includes a distal free edge portion and spaced apart side edge portions extending between the distal free edge portion and the support section, said side edge portions of the fin section tapering inwardly towards one another from the distal free edge thereof in the direction towards the support, the said edge portions terminating adjacent the heel portion of the support remote from the distal free end of the fin and wherein a part of each side edge portion which is disposed adjacent the support projects outwardly therefrom and tapers upwardly so as to form a channel between the outer peripheral edge and the wall of the support so that during a downward kick water is captured in the channel and directed from as far back as the ankle area down the channel towards the distal free end of the fin.

12. A swimming fin according to claim 11 wherein said support section includes a raised foot ridge which, when in use, extends over the user's foot, said channels being formed between the sides of the raised foot ridge and side edge portion of the fin adjacent the support section.

13. A swimming fin according to claim 11, further including at least one elongated substantially resilient element extending from the support section towards the distal free edge portion of the fin.

* * * * *

UNITED STATES PATENT AND TRADEMARK OFFICE

CERTIFICATE OF CORRECTION

PATENT NO. : 5,810,629

DATED : September 22, 1998

INVENTOR(S) : Michael Lancaster PARR

It is certified that error appears in the above-identified patent and that said Letters Patent is hereby corrected as shown below:

On the title page, item

[73] Assignee: Atsuko Parr, Surf Beach,
New South Wales, Australia

Signed and Sealed this

Fifteenth Day of June, 1999

*Attest:*

Q. TODD DICKINSON

*Attesting Officer*

*Acting Commissioner of Patents and Trademarks*